US009178274B2

(12) United States Patent
Wong et al.

(10) Patent No.: US 9,178,274 B2
(45) Date of Patent: Nov. 3, 2015

(54) COMMUNICATION DEVICE AND ANTENNA ELEMENT THEREIN

(71) Applicant: Acer Incorporated, Hsichih, New Taipei City (TW)

(72) Inventors: Kin-Lu Wong, New Taipei (TW); Hsuan-Jui Chang, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 316 days.

(21) Appl. No.: 13/839,808

(22) Filed: Mar. 15, 2013

(65) Prior Publication Data

US 2014/0197992 A1 Jul. 17, 2014

(30) Foreign Application Priority Data

Jan. 11, 2013 (TW) ..... 102101044 A

(51) Int. Cl.

| | |
|---|---|
| ***H01Q 1/36*** | (2006.01) |
| ***H01Q 9/42*** | (2006.01) |
| ***H01Q 5/378*** | (2015.01) |
| *H01Q 1/24* | (2006.01) |

(52) U.S. Cl.

CPC ..... *H01Q 1/36* (2013.01); *H01Q 5/378* (2015.01); *H01Q 9/42* (2013.01); *H01Q 1/243* (2013.01)

(58) Field of Classification Search

CPC ..... H01Q 1/243; H01Q 1/36; H01Q 9/42

See application file for complete search history.

(56) References Cited

U.S. PATENT DOCUMENTS

| | | | | |
|---|---|---|---|---|
| 6,646,606 | B2 * | 11/2003 | Mikkola et al. | 343/700 MS |
| 6,876,329 | B2 * | 4/2005 | Milosavljevic | 343/700 MS |
| 7,696,927 | B2 | 4/2010 | Bae et al. | |
| 7,973,726 | B2 * | 7/2011 | Tseng et al. | 343/702 |

(Continued)

FOREIGN PATENT DOCUMENTS

| | | |
|---|---|---|
| CN | 101138130 | 3/2008 |
| CN | 102315513 | 1/2012 |
| TW | 201114101 | 4/2011 |
| TW | 201143205 | 12/2011 |

OTHER PUBLICATIONS

European Search Report dated May 22, 2014.

(Continued)

*Primary Examiner* — Tho G Phan

(74) *Attorney, Agent, or Firm* — McClure, Qualey & Rodack, LLP

(57) ABSTRACT

A communication device includes a ground element and an antenna element. The antenna element is close to an edge of the ground element, and includes a first metal portion and a second metal portion. The first metal portion has a plurality of bends, and includes a first segment and a second segment. The first segment and the second segment are close to each other, and are substantially parallel to the edge of the ground element. The first segment is disposed at the outmost periphery of the antenna element from the edge of the ground element. The second segment is disposed between the first segment and the edge of the ground element, and has a shorted point coupled to the ground element. The second metal portion is disposed between the second segment and the edge of the ground element, and has a feeding point coupled to a signal source.

15 Claims, 3 Drawing Sheets

(56) References Cited

U.S. PATENT DOCUMENTS

| | | | | |
|---|---|---|---|---|
| 8,154,459 | B2 * | 4/2012 | Teshima et al. | 343/702 |
| 8,477,071 | B2 * | 7/2013 | Tsai et al. | 343/700 MS |
| 8,599,074 | B2 | 12/2013 | Wong et al. | |
| 2011/0084883 | A1 | 4/2011 | Wong et al. | |
| 2011/0267237 | A1 | 11/2011 | Wong et al. | |

OTHER PUBLICATIONS

English language translation of abstract of TW 201143205 (published Dec. 1, 2011).

Chinese language office action dated Aug. 11, 2015, issued in application No. 201310016094.7.

* cited by examiner

COMMUNICATION DEVICE AND ANTENNA ELEMENT THEREIN

CROSS REFERENCE TO RELATED APPLICATIONS

This Application claims priority of Taiwan Patent Application No. 102101044 filed on Jan. 11, 2013, the entirety of which is incorporated by reference herein.

BACKGROUND OF THE INVENTION

1. Field of the Invention

The disclosure generally relates to a communication device, and more particularly, relates to a communication device comprising a low-profile and wideband antenna element.

2. Description of the Related Art

In the modern mobile communication age, to satisfy the demands for different functions and portability of mobile communication devices (e.g., tablet computers or smart phones), stable communication quality has becomes more and more important for users, in particular, for applications of WWAN (Wireless Wide Area Network) and LTE (Long Term Evolution) communication systems in the modern tablet computers. Allocating a wideband antenna element with high radiation efficiency to a communication device is a common method for maintaining stable communication quality. However, a conventional wideband antenna element should have a predetermined distance to a ground plane to reduce the mutual coupling therebetween. This requirement causes an additional space required for the wideband antenna element embedded inside the communication device, which increases the antenna height above the ground plane and limits the application of the wideband antenna element.

To solve the foregoing problem, there is a need to design a low-profile and small-size wideband antenna element. The wideband antenna element should have high radiation efficiency and be able to be disposed within a limited space of a mobile communication device.

BRIEF SUMMARY OF THE INVENTION

The invention is aimed to provide a communication device comprising a wideband antenna element with high radiation efficiency. The antenna element with a simple structure has a low-profile and is small in size, and can be applied to a thin mobile communication device, for example, a smart phone, a tablet computer, or a notebook computer.

In a preferred embodiment, the invention provides a communication device, comprising: a ground element; and an antenna element, close to an edge of the ground element, wherein the antenna element comprises: a first metal portion, having a plurality of bends, wherein the first metal portion comprises a first segment and a second segment, the first segment is close to the second segment, the first segment and the second segment are substantially parallel to the edge of the ground element, the first segment is disposed at the outmost periphery of the antenna element from the edge of the ground element, the second segment is disposed between the first segment and the edge of the ground element, and the second segment has a shorted point coupled to the ground element; and a second metal portion, separated from the first metal portion, and disposed between the second segment of the first metal portion and the edge of the ground element, wherein the second metal portion has a feeding point coupled to a signal source, and the second metal portion is close to the second segment of the first metal portion to excite the first metal portion.

In some embodiments, the antenna element is configured to cover a first band and a second band. Frequencies of the first band are lower than those of the second band. The first metal portion generates a resonant mode in the first band, and further generates a first higher-order resonant mode and a second higher-order resonant mode in the second band. In some embodiments, the length of the first segment is substantially equal to the length of the second segment. In some embodiments, the length of each of the first segment and the second segment is at least 0.4 times the total length of the first metal portion. As a result, a combination of the first higher-order resonant mode and the second higher-order resonant mode forms a wide band to increase the bandwidth of the second band. In some embodiments, the first band is approximately from 704 MHz to 960 MHz, and the second band is approximately from 1710 MHz to 2690 MHz. In some embodiments, the second metal portion is substantially parallel to the first segment. In some embodiments, a coupling gap is formed between the second metal portion and the second segment such that the first metal portion is excited.

In some embodiments, the first metal portion substantially has a long and narrow inverted U-shape. The inverted U-shape may have less bends (e.g., just two or three bends), and accordingly, more uniformly-distributed surface currents can be excited on the first metal portion. This increases the bandwidth and the radiation efficiency in the first band and the second band.

In some embodiments, the first metal portion has a first open end, and the first segment is close to the first open end of the first metal portion or comprises the first open end of the first metal portion. In some embodiments, the first open end of the first metal portion is close to the shorted point of the second segment. In some embodiments, the second segment has a second open end, and the shorted point of the second segment is close to the second open end of the second segment or is located at the second open end of the second segment. As a result, the first metal portion can effectively reduce the total height of the antenna element, and a low-profile antenna can be formed. The antenna element can be applied to a thin mobile communication device.

In some embodiments, the communication device further comprises a connection element. The shorted point of the second segment is coupled through the connection element to the ground element. The connection element has a meandering structure. The meandering structure serves as an equivalent inductor which is coupled in parallel to the signal source and the antenna element. In addition, an equivalent capacitor is formed by a coupling gap between the second metal portion and the first metal portion. A combination of the equivalent inductor and the equivalent capacitor forms an internal matching circuit. The internal matching circuit can effectively increase the bandwidth of the resonant mode in the first band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures thereof in the invention are described in detail as follows.

Figure 1:
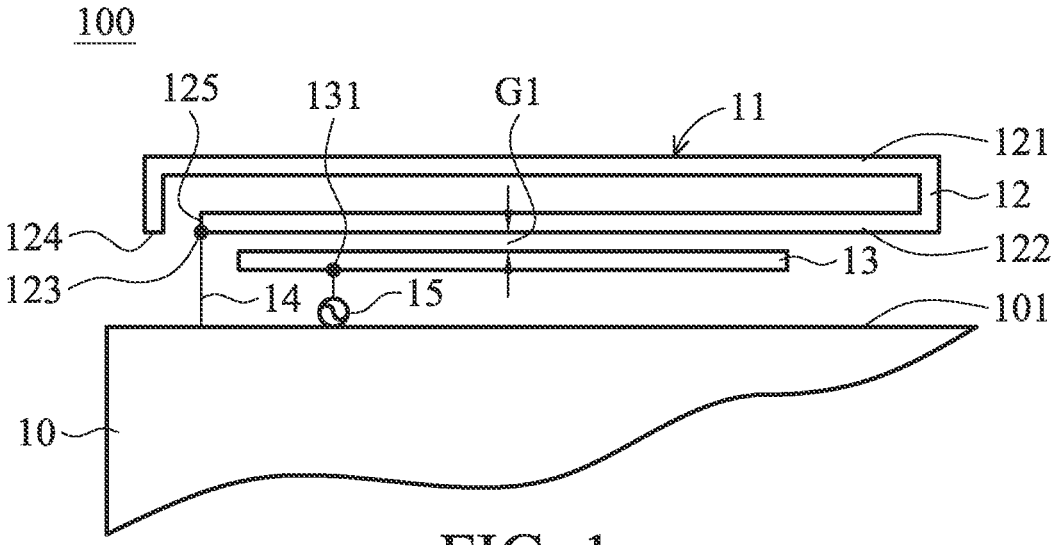
FIG. 1 is a diagram for illustrating a communication device according to a first embodiment of the invention.

FIG. 1 is a diagram for illustrating a communication device 100 according to a first embodiment of the invention. The communication device 100 may be a smart phone, a tablet computer, or a notebook computer. As shown in FIG. 1, the communication device 100 at least comprises a ground element 10 and an antenna element 11. In some embodiments, the ground element 10 is a metal ground plane disposed on a dielectric substrate (not shown). Note that the communication device 100 may further comprise other components, for example, a touch panel, a processor, a speaker, a battery, and a housing (not shown).

The antenna element 11 is close to an edge 101 of the ground element 10. The antenna element 11 comprises a first metal portion 12 and a second metal portion 13. The first metal portion 12 has a plurality of bends (e.g., two, three, or more bends). In some embodiments, the first metal portion 12 substantially has a long and narrow inverted U-shape. The first metal portion 12 comprises a first segment 121 and a second segment 122. The first segment 121 is close to the second segment 122. The first segment 121 and the second segment 122 are substantially parallel to the edge 101 of the ground element 10. The first segment 121 is disposed at the outmost periphery of the antenna element 11 from the edge 101 of the ground element 10. The second segment 122 is disposed between the first segment 121 and the edge 101 of the ground element 10. The second segment 122 further has a shorted point 123 coupled to the ground element 10. More particularly, the first metal portion 12 has a first open end 124, and the first segment 121 is close to the first open end 124 or comprises the first open end 124. In some embodiments, the first open end 124 of the first metal portion 12 is close to the shorted point 123 of the second segment 122. In some embodiments, the second segment 122 has a second open end 125, and the shorted point 123 of the second segment 122 is close to the second open end 125 or is located at the second open end 125. In some embodiments, a length of the first segment 121 is substantially equal to a length of the second segment 122. In some embodiments, each of the first segment 121 and the second segment 122 has a length which is at least 0.4 times the total length of the first metal portion 12. The second metal portion 13 is separated from the first metal portion 12, and is disposed between the second segment 122 and the edge 101 of the ground element 10. The second metal portion 13 has a feeding point 131 coupled to a signal source 15. The second metal portion 13 is close to the second segment 122 to excite the first metal portion 12 by capacitive coupling. In some embodiments, the second metal portion 13 substantially has a straight-line shape. In some embodiments, the second metal portion 13 is substantially parallel to the first segment 121, and a coupling gap G1 is formed between the second metal portion 13 and the second segment 122. For example, the coupling gap G1 is smaller than 2 mm.

Figure 2:
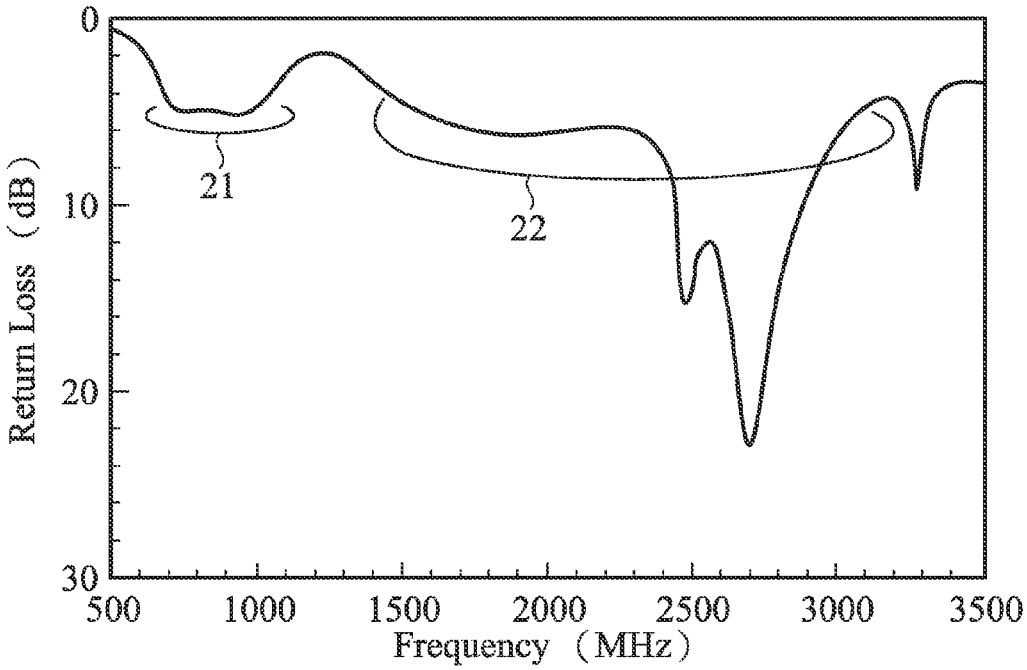
FIG. 2 is a diagram for illustrating return loss of an antenna element of a communication device according to a first embodiment of the invention.

FIG. 2 is a diagram for illustrating return loss of the antenna element 11 of the communication device 100 according to the first embodiment of the invention. In some embodiments, the element sizes of the communication device 100 are as follows. The ground element 10 has a length of about 200 mm and a width of about 150 mm. The antenna element 11 has a length of about 50 mm and a width of about 10 mm. The antenna element 11 is a low-profile planar structure disposed on an FR4 substrate having a thickness of about 0.8 mm. The first metal portion 12 has a length of about 110 mm. The first segment 121 has a length of about 60 mm. The second segment 122 has a length of about 50 mm. The second metal portion 13 has a length of about 45 mm. As shown in FIG. 2, the antenna element 11 at least covers a first band 21 and a second band 22. In a preferred embodiment, the first band 21 covers LTE700/GSM850/900 bands (from about 704 MHz to about 960 MHz), and the second band 22 covers GSM1800/1900/UMTS/LTE2300/2500 bands (from about 1710 MHz to about 2690 MHz). The invention provides the antenna element 11 having a low height (e.g., the height thereof is smaller or equal to 10 mm) and a small size (e.g., the length thereof is smaller or equal to 50 mm) Accordingly, the antenna element 11 can be applied to a variety of mobile communication devices, in particular, to tablet computers, and the antenna element 11 can cover LTE/WWAN 8 bands.

Figure 3:
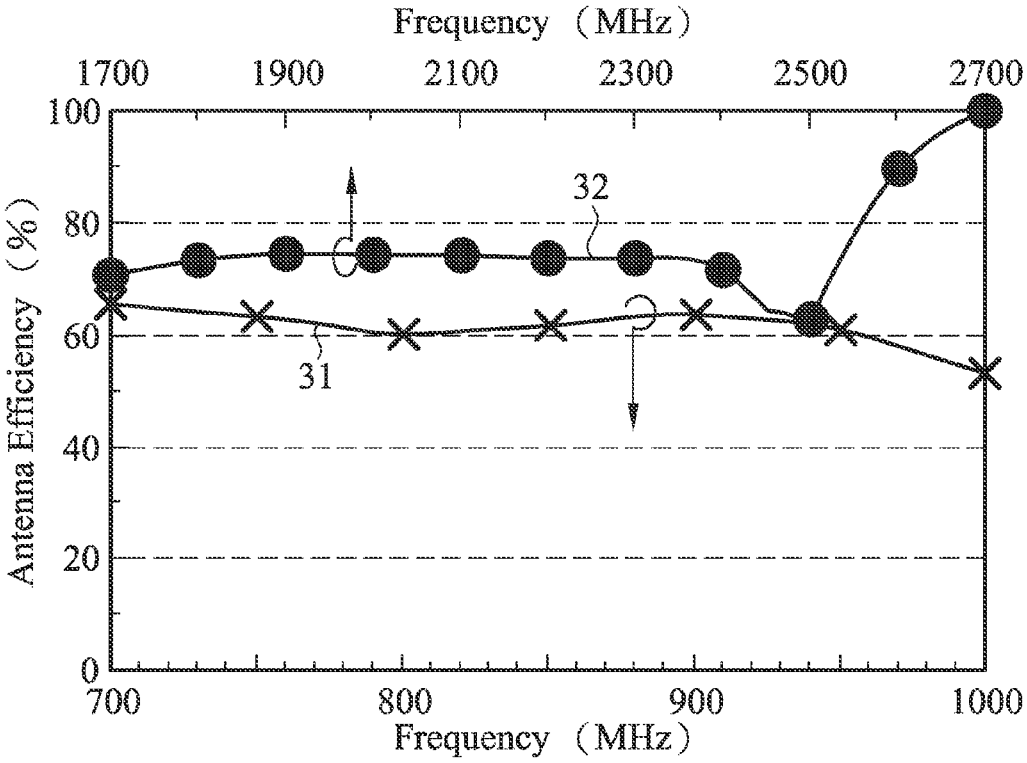
FIG. 3 is a diagram for illustrating antenna efficiency of an antenna element of a communication device according to a first embodiment of the invention.

FIG. 3 is a diagram for illustrating antenna efficiency of the antenna element 11 of the communication device 100 according to the first embodiment of the invention. In FIG. 3, the curve 31 represents the antenna efficiency (return losses included) of the antenna element 11 operating in the LTE700/GSM850/900 bands (from about 704 MHz to about 960 MHz), and the curve 32 represents the antenna efficiency (return losses included) of the antenna element 11 operating in the GSM1800/1900/UMTS/LTE2300/2500 bands (from about 1710 MHz to about 2690 MHz). According to the measurement in FIG. 3, the antenna efficiency of the antenna element 11 is approximately from 60% to 70% in the LTE700/GSM850/900 bands, and is approximately from 65% to 95% in the GSM1800/1900/UMTS/LTE2300/2500 bands. The antenna efficiency can meet requirements of practical applications. Based on FIG. 2 and FIG. 3, the antenna element 11 and the communication device 100 of the invention have advantages of wide bandwidth and high radiation efficiency.

Figure 4:
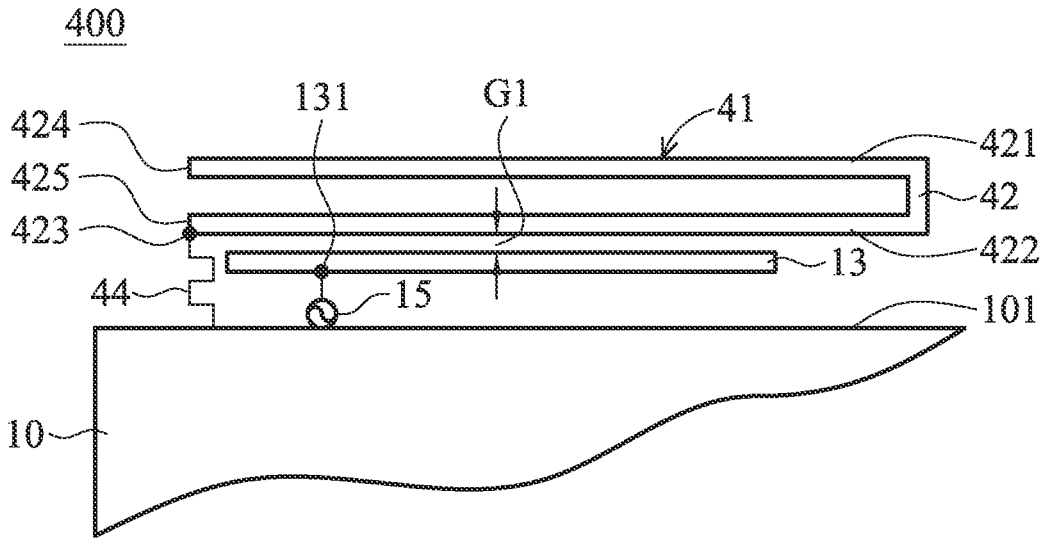
FIG. 4 is a diagram for illustrating a communication device according to a second embodiment of the invention.

FIG. 4 is a diagram for illustrating a communication device 400 according to a second embodiment of the invention. FIG. 4 is similar to FIG. 1. As to a first metal portion 42 in the embodiment, the length of a first segment 421 is substantially equal to the length of a second segment 422, and a shorted point 423 of the second segment 422 is located at a second open end 425 of the second segment 422 and is close to a first open end 424 of the first metal portion 42. The communication device 400 further comprises a connection element 44. The shorted point 423 of the second segment 422 is coupled through the connection element 44 to the ground element 10. In some embodiments, the connection element 44 has a meandering structure to adjust the impedance matching of an antenna element 41 thereof. For example, the connection element 44 may substantially have a W-shape or an S-shape, but is not limited to the above. Other features of the communication device 400 of FIG. 4 are similar to those of the communication device 100 of FIG. 1. Accordingly, the two embodiments can achieve similar performances.

Figure 5:
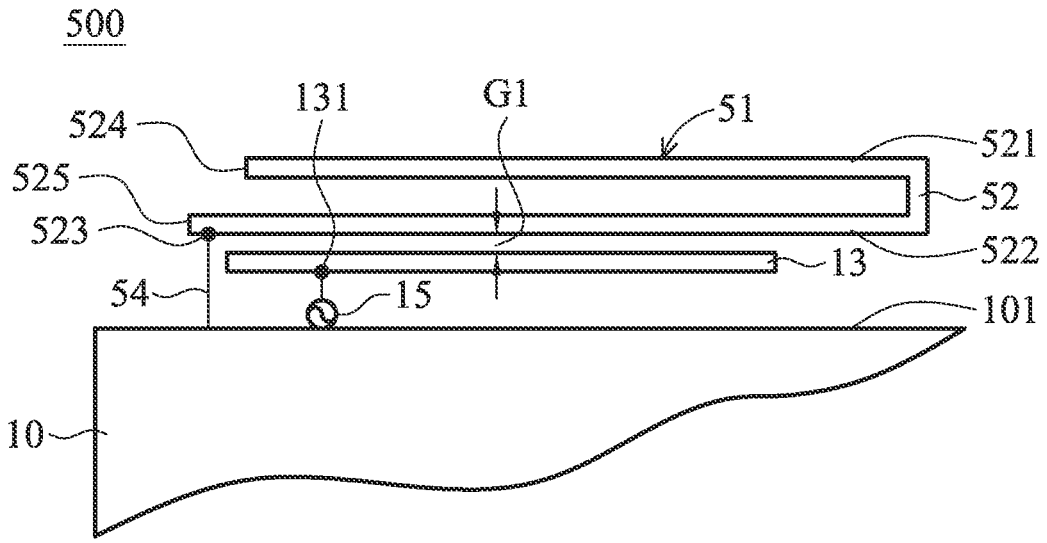
FIG. 5 is a diagram for illustrating a communication device according to a third embodiment of the invention.

FIG. 5 is a diagram for illustrating a communication device 500 according to a third embodiment of the invention. FIG. 5 is similar to FIG. 1. As to a first metal portion 52 in the embodiment, the length of a first segment 521 is slightly smaller than the length of a second segment 522, and a shorted point 523 of the second segment 522 is close to a first open end 524 of the first metal portion 52 and close to a second open end 525 of the second segment 522. Other features of the communication device 500 of FIG. 5 are similar to those of the communication device 100 of FIG. 1. Accordingly, the two embodiments can achieve similar performances.

Note that the above element sizes, element shapes, and element parameters are not limitations of the invention. An antenna designer can adjust these setting values according to different requirements.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a ground element; and an antenna element, close to an edge of the ground element, wherein the antenna element comprises:

a first metal portion, having a plurality of bends, wherein the first metal portion comprises a first segment and a second segment, the first segment is close to the second segment, the first segment and the second segment are substantially parallel to the edge of the ground element, the first segment is disposed at the outmost periphery of the antenna element from the edge of the ground element, the second segment is disposed between the first segment and the edge of the ground element, and the second segment has a shorted point coupled to the ground element; and a second metal portion, separated from the first metal portion, and disposed between the second segment of the first metal portion and the edge of the ground element, wherein the second metal portion has a feeding point coupled to a signal source, and the second metal portion is close to the second segment of the first metal portion to excite the first metal portion by capacitive coupling;

wherein the shorted point of the second segment is coupled through a path to the ground element, and the path excludes the first segment.

2. The communication device as claimed in claim 1, wherein a length of the first segment is substantially equal to a length of the second segment.

3. The communication device as claimed in claim 1, wherein each of the first segment and the second segment has a length which is at least 0.4 times the total length of the first metal portion.

4. The communication device as claimed in claim 1, wherein the second metal portion is substantially parallel to the first segment, and a coupling gap is formed between the second metal portion and the second segment.

5. The communication device as claimed in claim 4, wherein the coupling gap is smaller than 2 mm.

6. The communication device as claimed in claim 1, wherein the first metal portion substantially has an inverted U-shape.

7. The communication device as claimed in claim 1, wherein the first metal portion has a first open end, and the first segment is close to the first open end of the first metal portion.

8. The communication device as claimed in claim 7, wherein the first open end of the first metal portion is close to the shorted point of the second segment.

9. The communication device as claimed in claim 1, wherein the first metal portion has a first open end, and the first segment comprises the first open end of the first metal portion.

10. The communication device as claimed in claim 9, wherein the first open end of the first metal portion is close to the shorted point of the second segment.

11. The communication device as claimed in claim 1, wherein the second segment has a second open end, and the shorted point of the second segment is close to the second open end of the second segment.

12. The communication device as claimed in claim 1, wherein the second segment has a second open end, and the shorted point of the second segment is located at the second open end of the second segment.

13. The communication device as claimed in claim 1, further comprising:

a connection element, wherein the shorted point of the second segment is coupled through the connection element to the ground element.

14. The communication device as claimed in claim 13, wherein the connection element has a meandering structure.

15. The communication device as claimed in claim 1, wherein the antenna element covers a first band and a second band, the first band is approximately from 704 MHz to 960 MHz, and the second band is approximately from 1710 MHz to 2690 MHz.

* * * * *